US009091953B2

(12) United States Patent
Nanai

(10) Patent No.: US 9,091,953 B2
(45) Date of Patent: Jul. 28, 2015

(54) IMAGE FORMING APPARATUS

(71) Applicant: CANON KABUSHIKI KAISHA, Tokyo (JP)

(72) Inventor: Ryosuke Nanai, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 28 days.

(21) Appl. No.: 14/018,748

(22) Filed: Sep. 5, 2013

(65) Prior Publication Data

US 2014/0079443 A1 Mar. 20, 2014

(30) Foreign Application Priority Data

Sep. 18, 2012 (JP) ..... 2012-203902

(51) Int. Cl.
*G03G 15/01* (2006.01)
*G03G 15/00* (2006.01)

(52) U.S. Cl.
CPC ..... *G03G 15/0131* (2013.01); *G03G 15/5058* (2013.01); *G03G 2215/0129* (2013.01); *G03G 2215/0161* (2013.01)

(58) Field of Classification Search
CPC ..... G03G 15/5058; G03G 15/0131; G03G 2215/0161; G03G 2215/0129
USPC ..... 399/301, 49, 74; 347/116
See application file for complete search history.

(56) References Cited

U.S. PATENT DOCUMENTS

| | | | | |
|---|---|---|---|---|
| 7,590,364 | B2 | 9/2009 | Takezawa et al. | |
| 2008/0089706 | A1 * | 4/2008 | Nakazato et al. | |
| 2012/0045234 | A1 * | 2/2012 | Suzuki et al. | 399/301 |
| 2013/0164047 | A1 | 6/2013 | Kakutani et al. | |

FOREIGN PATENT DOCUMENTS

| | | | |
|---|---|---|---|
| JP | 2007-78874 | A | 3/2007 |
| JP | 2008-96744 | A | 4/2008 |
| JP | 2012003001 | A * | 1/2012 |

* cited by examiner

*Primary Examiner* — Susan Lee
(74) *Attorney, Agent, or Firm* — Fitzpatrick, Cella, Harper & Scinto

(57) ABSTRACT

An image forming apparatus, including: an image forming unit configured to form toner images on an image bearing member and toner patterns for detecting a relative position of the toner images; a detection unit having a light emission unit and a light receiving unit configured to receive reflection light from the image bearing member and the toner patterns to output an analog signal; a conversion unit configured to convert the analog signal into a digital signal based on a threshold value; a correction unit configured to correct a misregistration between the toner images on a recording medium based on the digital signal; and a control unit configured to control, when values of the analog signal includes a value lower than the threshold value, light intensity of the light emission unit so that the values of the analog signal become higher than the threshold value.

11 Claims, 7 Drawing Sheets

IMAGE FORMING APPARATUS

BACKGROUND OF THE INVENTION

1. Field of the Invention

The present invention relates to an image forming apparatus which corrects a misregistration between a plurality of toner images transferred onto a recording medium.

2. Description of the Related Art

Conventionally, there is known an electrophotographic color image forming apparatus in which toner images formed on a plurality of photosensitive members are transferred onto a recording medium so that a color image is formed on the recording medium. Because it is very difficult to eliminate manufacturing variations of components and an assembly error of the color image forming apparatus, there may occur a color misregistration (out of color registration) between images formed on the recording medium. Therefore, the image forming apparatus is equipped with a structure configured to correct the color misregistration.

As one method of correcting the color misregistration, the following color misregistration correction control is known. In order to detect the color misregistration, a toner pattern for position detection purpose (toner patch) is formed on each of the plurality of photosensitive members. The toner pattern for position detection purpose formed on each of the plurality of photosensitive members is transferred onto an image bearing member such as an intermediate transfer member or a recording medium transport member. A position of the toner pattern for position detection purpose which is transferred onto the image bearing member is detected, and an amount of color misregistration is obtained on the basis of the detection result. On the basis of the obtained amount of color misregistration, the color misregistration correction control is performed so as to correct each position at which each color toner image is formed. An optical sensor is used for detecting the position of the toner pattern for position detection purpose (see Japanese Patent Application Laid-Open No. 2008-96744). The optical sensor detects the position of the toner pattern for position detection purpose by irradiating the image bearing member and the toner pattern for position detection purpose with light and by detecting reflection light.

If the toner patterns for position detection purpose are formed to be overlapped at a portion having locally low reflectance due to a flaw or dirt which occurs in a manufacturing process of the image bearing member such as the intermediate transfer member or the recording medium transport member or occurs due to deterioration over time, a correct formation position of the toner pattern for position detection purpose may be detected incorrectly. The image forming apparatus described in Japanese Patent Application Laid-Open No. 2008-96744 can prevent an influence of the flaw or dirt on the color misregistration correction by performing a masking process of correcting intensity of the reflection light from the flaw or dirt so that the flaw or dirt is not recognized as the toner pattern for position detection purpose.

Further, if the reflectance of a surface of the image bearing member is decreased by deterioration of the image bearing member such as the intermediate transfer member or the recording medium transport member, the light intensity of a light emitting portion is controlled to be increased for reliably detecting the toner pattern for position detection purpose (see Japanese Patent Application Laid-Open No. 2007-78874).

However, the masking process described in Japanese Patent Application Laid-Open No. 2008-96744 cannot be performed on a detection result in a vicinity of a position where the toner pattern for position detection purpose is formed. Therefore, the following problem occurs. Specifically, if the toner patterns for position detection purpose are formed to be overlapped on a part of the flaw or dirt on the image bearing member in the transport direction of the image bearing member, a width of the toner pattern for position detection purpose in the transport direction of the image bearing member is detected to be larger than the real width. If the width of the toner pattern for position detection purpose is detected to be larger than the real width, detection accuracy of the position at which the toner pattern for position detection purpose is formed is decreased.

SUMMARY OF THE INVENTION

Therefore, the present invention provides an image forming apparatus which can prevent accuracy in correction of color misregistration from being decreased even if there is a part having locally low reflectance in an image bearing member configured to bear a toner pattern for position detection purpose.

In order to solve the above-mentioned problem, an image forming apparatus according to one embodiment of the present invention comprises: an image forming unit configured to form toner images to be transferred onto a recording medium, on an image bearing member on which the toner images formed on a plurality of photosensitive members by the image forming unit is transferred by the image forming unit, wherein the image forming unit forms toner patterns for detecting a relative position of the toner images on the image bearing member; a detection unit including: a light emission unit configured to irradiate with light the image bearing member and the toner patterns; and a light receiving unit disposed at a position for receiving a reflection light of the light emitted from the light emission unit reflected from one of the image bearing member and the toner patterns, the detection unit being configured to output an analog signal based on a light intensity of the reflection light received by the light receiving unit; a conversion unit configured to convert the analog signal into a digital signal based on a predetermined threshold value; a correction unit configured to correct a misregistration between the toner images transferred onto the recording medium based on the digital signal; and a control unit configured to control, when values of the analog signal based on the light intensity of the reflection light from the image bearing member includes a value lower than the threshold value, light intensity of the light from the light emission unit irradiating the image bearing member and the toner patterns so that the values of the analog signal based on the light intensity of the reflection light from the image bearing member become higher than the threshold value.

Further features of the present invention will become apparent from the following description of exemplary embodiments with reference to the attached drawings.

DESCRIPTION OF THE EMBODIMENTS

Now, embodiments of the present invention will be described in detail with reference to the drawings.

Figure 1:
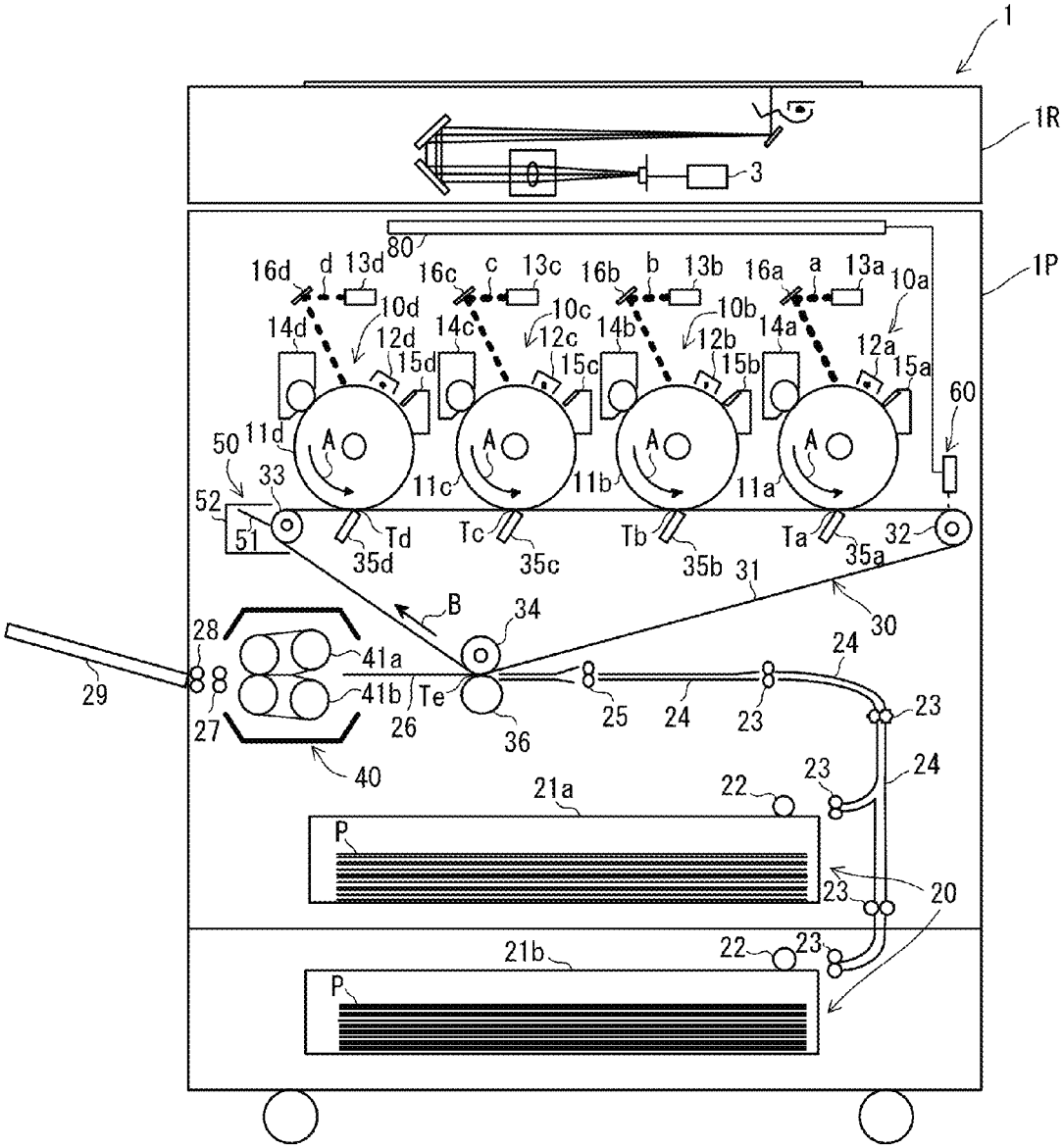
FIG. 1 is a cross-sectional view of an image forming apparatus.

FIG. 1 is a cross-sectional view of an image forming apparatus 1.

The image forming apparatus 1 is an electrophotographic color image forming apparatus including a plurality of (four in the embodiment) image forming portions 10 (10*a*, 10*b*, 10*c*, and 10*d*) arranged in a line. In the embodiment, the image forming apparatus 1 includes an image reading portion 1R and an image output portion 1P. The image reading portion 1R reads an image of a document in an optical manner and converts information on the read image into a record image signal (electric signal) by a record image signal output portion 3. The record image signal output portion 3 of the image reading portion 1R transmits the record image signal to a control unit 80 of the image output portion 1P.

The image output portion 1P includes the image forming portions 10, a sheet feed unit 20, an intermediate transfer unit 30, a fixing unit 40, a cleaning unit 50, photosensors (detection devices) 60, and the control unit 80.

A photosensitive drum (photosensitive member) 11 (11*a*, 11*b*, 11*c*, or 11*d*) is pivotally supported in each of the image forming portions 10 in a rotatable manner in a direction (counterclockwise direction) indicated by the arrow A. Opposite to the outer circumferential surface of the photosensitive drum 11, a primary charger 12, a laser scanner unit (exposing device) 13, a developing device 14, and a cleaning device 15 are disposed in this order in the rotation direction A. A mirror 16 (16*a*, 16*b*, 16*c*, or 16*d*) is disposed between the laser scanner unit 13 (13*a*, 13*b*, 13*c*, or 13*d*) and the photosensitive drum 11.

The image forming portions 10 form, on the plurality of photosensitive drums 11, respectively, toner images to be transferred onto a recording medium P.

The sheet feed unit 20 includes sheet feed cassettes 21*a* and 21*b* which store the recording media P. A pickup roller 22 feeds the recording media P one by one from the sheet feed unit 20. Each recording medium P is transported to registration rollers 25 by transport rollers 23 through a transport path 24.

The intermediate transfer unit 30 includes a drive roller 32, a driven roller 33, and an intermediate transfer belt (intermediate transfer member) 31 which is an image bearing member wrapping around the drive roller 32 and the driven roller 33. The intermediate transfer belt is rotated in a direction (clockwise direction) indicated by the arrow B. On the inner side of the intermediate transfer belt 31, there are disposed primary transfer members 35 (35*a*, 35*b*, 35*c*, and 35*d*) and a secondary transfer roller 34.

The primary transfer member 35 is disposed opposite to the photosensitive drum 11 so as to form a primary transfer portion Ta, Tb, Tc, or Td between the primary transfer member 35 and the photosensitive drum 11. The secondary transfer roller 34 is disposed opposite to an opposing roller 36 so as to form a secondary transfer portion Te between the secondary transfer roller 34 and the opposing roller 36.

The fixing unit 40 is disposed downstream of the secondary transfer portion Te in the transport direction of the recording medium P. The fixing unit 40 includes a heating rotation member 41*a*, a pressure rotation member 41*b*, and fixing exit rollers 27.

The cleaning unit 50 is configured to be separable from and in contact with the intermediate transfer belt 31. The cleaning unit 50 includes a cleaning blade 51 configured to scrape off toner remaining on the intermediate transfer belt 31 and a waste toner container configured to collect the toner scraped off by the cleaning blade 51.

Each photosensor (detection device) 60 irradiates with light the intermediate transfer belt 31 and toner patterns 201 for position detection purpose which are transferred onto the intermediate transfer belt 31 and receives regular reflection light from the intermediate transfer belt 31 or the toner patterns 201 for position detection purpose as described later. The photosensor 60 outputs an analog signal based on light intensity of the received regular reflection light.

A light receiving circuit (converter device) 903 (FIG. 8) described later converts the analog signal from the photosensor 60 into a digital signal based on a predetermined threshold value.

The control unit (color misregistration correction unit) 80 corrects a misregistration (color misregistration) between a plurality of toner images transferred onto the recording medium P based on the digital signal from the light receiving circuit 903 as described later. In other words, the control unit 80 performs color misregistration correction of an image to be formed based on the detection result obtained by detecting the toner patterns 201 for position detection purpose by the photosensor 60.

The primary charger 12 (12*a*, 12*b*, 12*c*, or 12*d*) charges a surface of the photosensitive drum 11 uniformly. The laser scanner unit 13 irradiates the uniformly charged surface of the photosensitive drum 11 with a laser beam (hereinafter referred to as a light beam) modulated in accordance with a record image signal from the record image signal output portion 3 of the image reading portion 1R via the mirror 16, to thereby form an electrostatic latent image.

The developing device 14 (14*a*, 14*b*, 14*c*, or 14*d*) causes developer (hereinafter referred to as toner) to adhere to the electrostatic latent image, to thereby form a developer image (hereinafter referred to as a toner image).

A yellow (Y) toner image on the photosensitive drum 11*d* is transferred onto the intermediate transfer belt by the primary transfer member 35*d* in the primary transfer portion Td. A magenta (M) toner image on the photosensitive drum 11*c* is transferred onto the yellow toner image on the intermediate transfer belt 31 by the primary transfer member 35*c* in the primary transfer portion Tc. A cyan (C) toner image on the photosensitive drum lib is transferred onto the magenta toner image on the intermediate transfer belt 31 by the primary transfer member 35*b* in the primary transfer portion Tb. A black (Bk) toner image on the photosensitive drum 11*a* is transferred onto the cyan toner image on the intermediate transfer belt 31 by the primary transfer member 35*a* in the primary transfer portion Ta. In this way, the yellow toner image, the magenta toner image, the cyan toner image, and the black toner image are sequentially transferred and overlaid on the intermediate transfer belt 31 by the primary transfer members 35.

The control unit 80 adjusts an emission timing of the light beam from the laser scanner unit 13 based on the detection result of the photosensor 60, to thereby perform registration for adjusting the positions of the plurality of toner images so as to correct the color misregistration.

The cleaning device 15 (15*a*, 15*b*, 15*c*, or 15*d*) removes toner remaining on the photosensitive drum 11 after the primary transfer.

The registration rollers 25 transport the recording medium P to the secondary transfer portion Te in synchronization with the toner images overlaid on the intermediate transfer belt 31.

The toner images on the intermediate transfer belt 31 are collectively transferred onto the recording medium P by the secondary transfer roller 34 in the secondary transfer portion Te. After that, the recording medium P is transported to the fixing unit 40. The recording medium P is heated and pressurized by the heating rotation member 41*a* and the pressure rotation member 41*b*. Thus, the toner images are fixed to the recording medium P as a color image. The recording medium P with the fixed color image is delivered onto a delivery tray 29 outside the image forming apparatus 1 by the fixing exit rollers 27 and delivery rollers 28.

The toner remaining on the intermediate transfer belt 31 without being transferred onto the recording medium P is scraped off by the cleaning blade 51 of the cleaning unit 50. The toner scraped off by the cleaning blade 51 is collected in the waste toner container 52.

Figure 2:
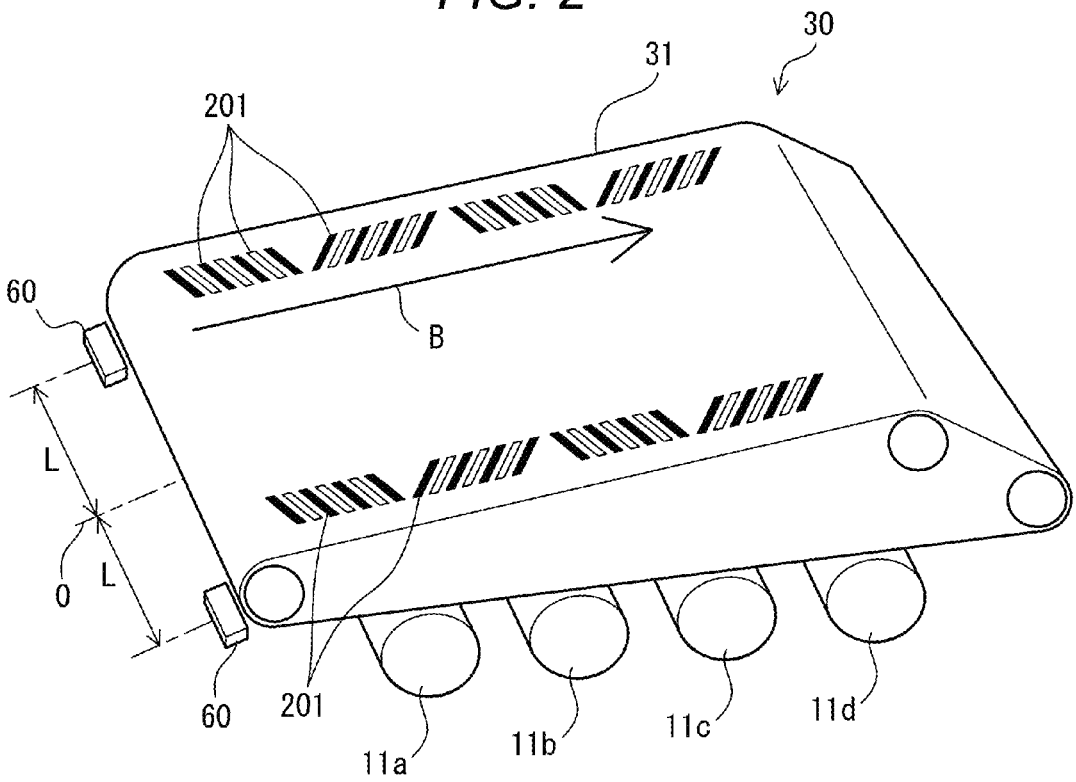
FIG. 2 is a diagram illustrating photosensors and toner patterns for position detection purpose.

FIG. 2 is a diagram illustrating the photosensors 60 and the toner patterns (toner patches) 201 for position detection purpose. The image forming portion 10 forms the toner patterns 201 for position detection purpose on each end portion in the width direction of the intermediate transfer belt 31. The toner pattern 201 for position detection purpose is a toner image formed in a predetermined pattern for detecting color misregistration (out of registration) of each toner image overlaid and transferred onto the intermediate transfer belt 31 from each photosensitive drum 11. FIG. 2 illustrates the photosensors 60 and the toner patterns 201 for position detection purpose when the intermediate transfer belt 31 is viewed from below in the image forming apparatus 1 of FIG. 1.

The photosensors 60 are disposed above the intermediate transfer belt 31 for detecting positions of the toner patterns 201 for position detection purpose which are formed on the intermediate transfer belt 31. Each photosensor 60 irradiates the intermediate transfer belt 31 with light and detects reflection light from the toner patterns 201 for position detection purpose on the intermediate transfer belt 31, to thereby obtain information of color misregistration. In order to detect the respective toner patterns 201 for position detection purpose which are formed on both ends in the width direction of the intermediate transfer belt 31, the photosensors 60 are disposed at two positions each spaced apart from a center O in the width direction of the intermediate transfer belt 31 by a distance L. Because the photosensors 60 are disposed at the two positions, it is possible to detect inclination of the image in the width direction of the intermediate transfer belt 31 and an image width (image magnification).

Next, with reference to FIGS. 3A and 3B, a principle of detecting the toner patterns 201 for position detection purpose by the photosensors 60 will be described.

Figure 3A:
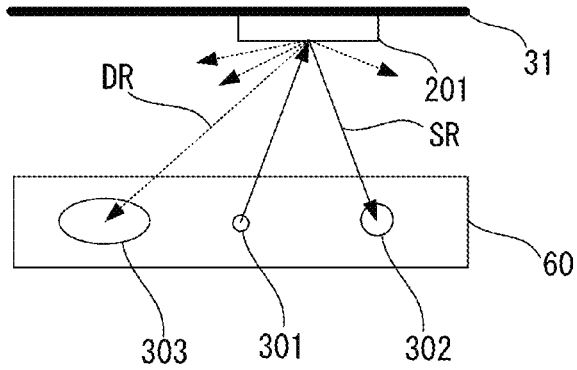
FIGS. 3A and 3B are explanation diagrams of the photosensor.
Figure 3B:
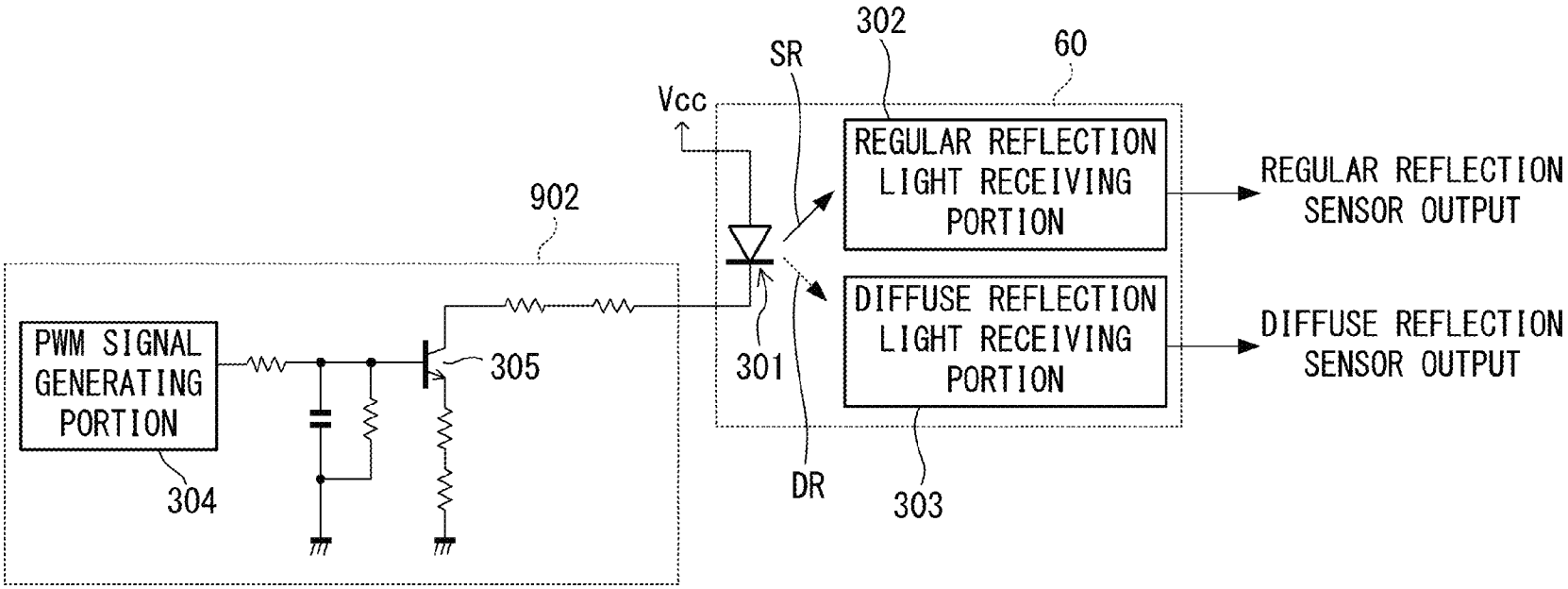

FIGS. 3A and 3B are explanatory diagrams of the photosensor 60. FIG. 3A is a diagram illustrating a structure of the photosensor 60. FIG. 3B is a block diagram illustrating a circuit of the photosensor 60.

The photosensor 60 includes a light emitting portion 301, a regular reflection light receiving portion 302, and a diffuse reflection light receiving portion 303. As the light emitting portion 301, a light emitting diode (LED) is used, for example. As the regular reflection light receiving portion 302 and the diffuse reflection light receiving portion 303, a photodiode (light receiving element) is used, for example. The light emitted from the light emitting portion 301 irradiates the intermediate transfer belt 31. As illustrated in FIG. 3A, the light irradiating the toner pattern 201 for position detection purpose on the intermediate transfer belt 31 is diffused in all directions. The regular reflection light receiving portion 302 is disposed at a position for receiving regular reflection light of the light from the light emitting portion 301 irradiating the intermediate transfer belt 31 or the toner pattern 201 for position detection purpose on the intermediate transfer belt 31. Among the diffused light, light reaching the diffuse reflection light receiving portion 303 is referred to as diffuse reflection light DR, and light reaching the regular reflection light receiving portion 302 is referred to as regular reflection light SR.

The regular reflection light receiving portion 302 converts the light intensity of the regular reflection light SR received by the photodiode of the regular reflection light receiving portion 302 into an electric signal. The diffuse reflection light receiving portion 303 converts the light intensity of the diffuse reflection light DR received by the photodiode of the diffuse reflection light receiving portion 303 into an electric signal.

In FIG. 3B, the photosensor 60 is electrically connected to a sensor driving circuit (control device) 902. The sensor driving circuit 902 includes a pulse width modulation signal (hereinafter referred to as a PWM signal) generating portion 304 and a light emitting portion driving element 305. The PWM signal generating portion 304 generates a PWM signal (light emitting portion drive signal) for driving the light emitting portion 301 of the photosensor 60. The PWM signal generating portion 304 performs DC smoothing of the PWM signal by a filter so as to drive the light emitting portion 301 via the light emitting portion driving element 305. As a duty ratio of the PWM signal generated by the PWM signal generating portion 304 (drive duty ratio of the light emitting portion 301) is higher, the voltage after the DC smoothing becomes higher so that light intensity of the light emitting portion 301 becomes higher (brighter).

Figure 4A:
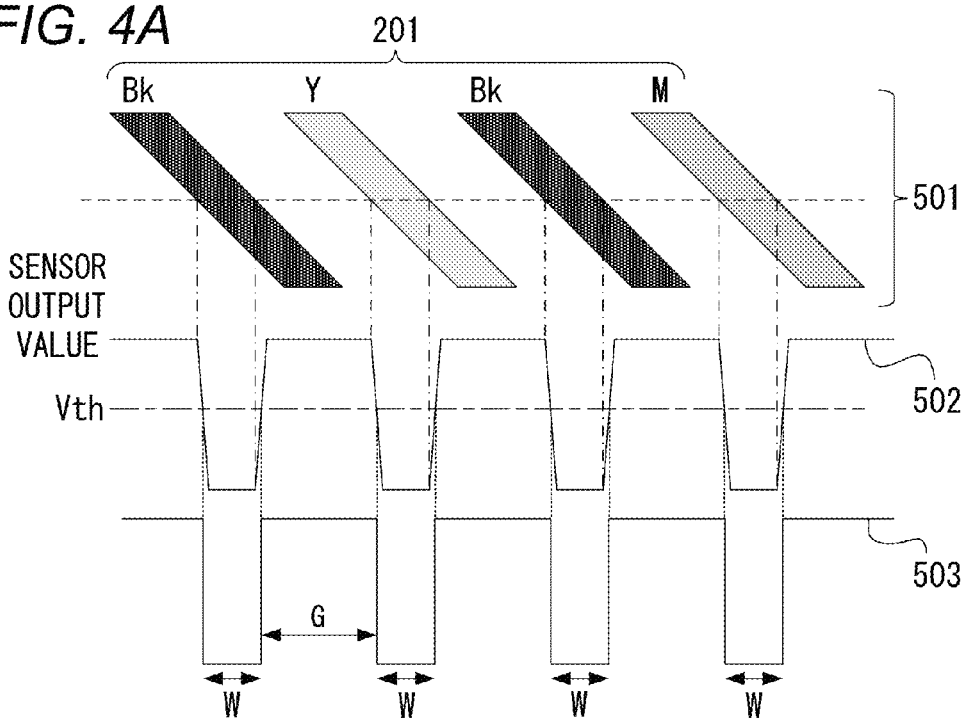
FIGS. 4A and 4B are diagrams illustrating a relationship between the toner pattern for position detection purpose and a sensor output value.
Figure 4B:
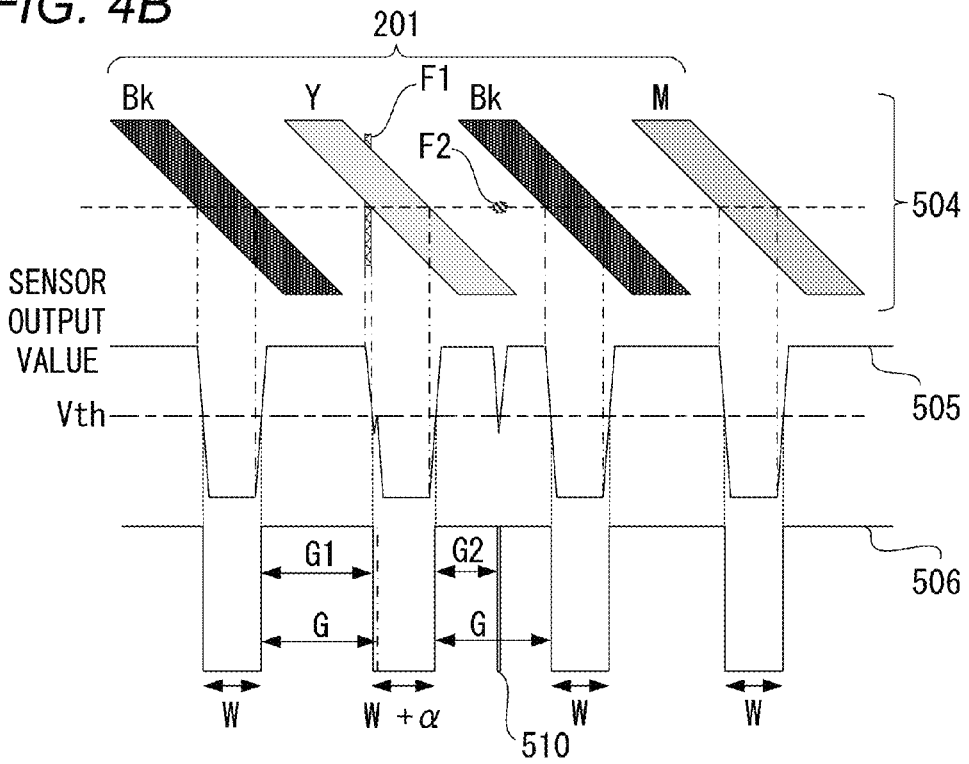

FIGS. 4A and 4B are diagrams illustrating a relationship between the toner patterns 201 for position detection purpose and a sensor output value (detection value or value of the analog signal).

With reference to FIG. 4A, a principle of detecting the toner patterns 201 for position detection purpose by a regular reflection method so as to detect the amount of color misregistration will be described. The color misregistration is caused by deviations among writing start positions of the Y, M, C, and Bk electrostatic latent images caused by distortion of the laser scanner unit 13.

The regular reflection light receiving portion 302 detects the regular reflection light SR from each toner pattern 201 for position detection purpose (501 in FIG. 4A). The regular reflection light receiving portion 302 converts light intensity of the received regular reflection light SR into an electric signal and outputs an electric signal (analog signal) 502 having an analog waveform as the sensor output value. The light receiving circuit 903 (FIG. 8) described later functions as an A/D converter, which converts the electric signal 502 having an analog waveform into a rectangular wave (digital signal) 503 by using a threshold voltage (threshold value or set reference value) Vth. In the rectangular wave 503, a line width of the toner pattern 201 for position detection purpose is indicated by W.

A gap G between waves in the rectangular wave 503 is counted by a clock counter 904 (FIG. 8), and each gap G between each color (Y, M, or C) and black (Bk) is measured.

Based on the measurement result of the gap G, each amount of color misregistration (relative positional relationship) between each color (Y, M, or C) and black (Bk) is calculated, and the amount of color misregistration is fed back to the control unit 80 as a correction value. The color misregistration is caused by deviations among the writing start positions of the Y, M, C, and Bk electrostatic latent images. The control unit 80 corrects the color misregistration by adjusting the writing start timing of the laser scanner unit 13 (emission timing of the light beam). Note that, a middle point of each rectangular wave illustrated in FIGS. 4A and 4B may be detected as a position of forming each color toner pattern for position detection purpose, and a gap between the middle points of the rectangular waves may be counted by the clock counter, to thereby detect a relative positional relationship (color misregistration) between the toner patterns for position detection purpose.

FIG. 4B illustrates an example of an output waveform when the photosensor 60 detects the intermediate transfer belt 31 with a flaw or dirt occurred in a manufacturing process or by deterioration over time.

In the toner patterns 201 for position detection purpose designated by a numerical reference 504 in FIG. 4B, the yellow (Y) toner pattern for position detection purpose is formed on a flaw F1 of the intermediate transfer belt 31. In addition, there is a dirt F2 between the yellow (Y) toner pattern for position detection purpose and the black (Bk) toner pattern for position detection purpose. If there is a part having low reflectance such as the flaw F1 or the dirt F2 on the intermediate transfer belt 31, the regular reflection light receiving portion 302 which has detected the toner patterns 201 for position detection purpose designated by the numerical reference 504 outputs an electric signal 505 having an analog waveform as the sensor output value. Using the threshold voltage Vth, the electric signal 505 having an analog waveform is A/D converted so that a rectangular wave 506 is obtained.

When the yellow (Y) toner pattern 201 for position detection purpose is formed on the flaw F1, the yellow (Y) toner pattern 201 for position detection purpose may be formed adjacent to the flaw F1 as illustrated in FIG. 4B. In this case, as indicated by the rectangular wave 506, it is detected that a line width W+α of the yellow (Y) toner pattern 201 for position detection purpose is larger than a line width W of the other toner patterns 201 for position detection purpose. Therefore, a gap between the black (Bk) toner pattern 201 for position detection purpose and the yellow (Y) toner pattern 201 for position detection purpose is detected as a gap G1 smaller than the actual gap G. If such an erroneous gap G1 is detected, the accuracy in correction of color misregistration is deteriorated.

In addition, if a masking process of the dirt F2 between the yellow (Y) toner pattern 201 for position detection purpose and the black (Bk) toner pattern 201 for position detection purpose is not performed, a wave 510 is detected in the rectangular wave 506. Therefore, a gap between the yellow (Y) toner pattern 201 for position detection purpose and the black (Bk) toner pattern 201 for position detection purpose is detected as a gap G2 different from the actual gap G. If such an erroneous gap G2 is detected, the accuracy in correction of color misregistration is deteriorated.

If a unit configured to determine whether or not erroneous detection has occurred is disposed, and if it is determined that erroneous detection has occurred, it is possible to avoid using the toner pattern 201 for position detection purpose which causes the erroneous detection. However, in a concept of absorbing a decentering component of the drive roller 32 by writing a plurality of sets on one circumference of the intermediate transfer belt 31, if one set of the toner patterns 201 for position detection purpose cannot be used, the accuracy in correction of color misregistration may be deteriorated.

Next, with reference to FIGS. 5A, 5B, 5C, and 6, the sensor output value of the regular reflection light SR of the intermediate transfer belt 31 with respect to light intensity of the light emitting portion 301 will be described.

Figure 5A:
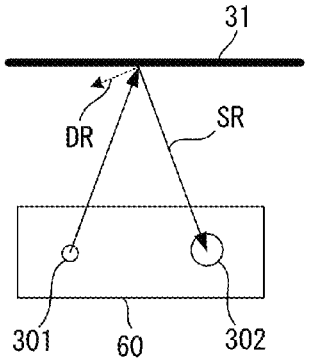
FIGS. 5A, 5B, and 5C are diagrams illustrating reflectances of different reflection members.
Figure 5B:
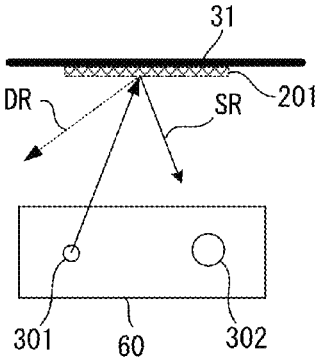
Figure 5C:
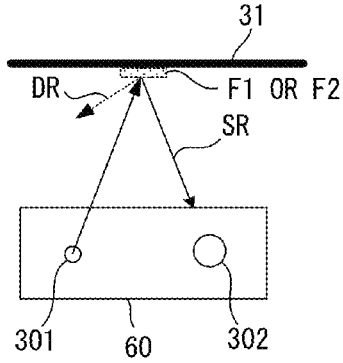
Figure 6:
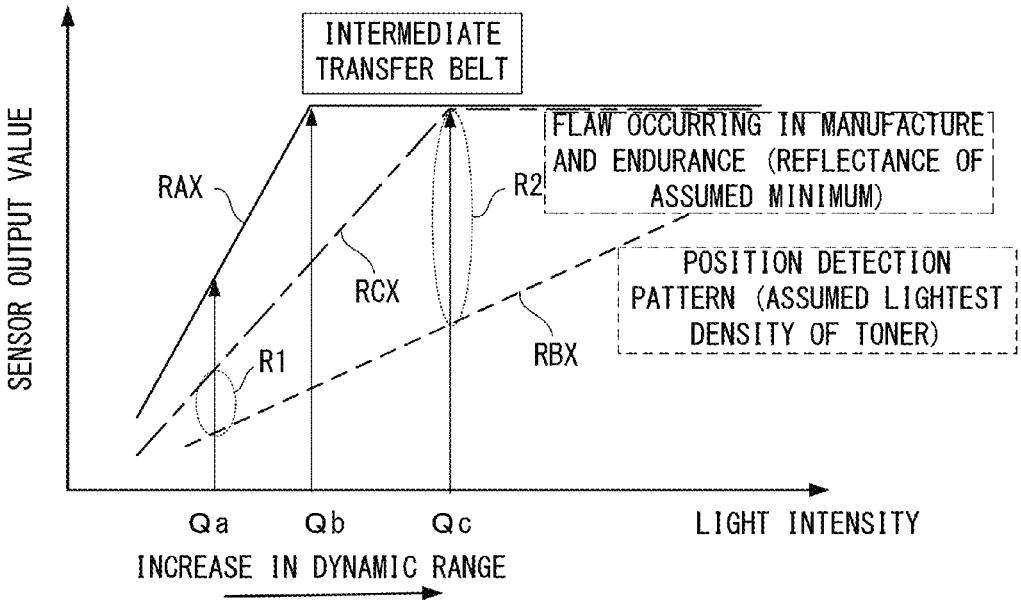
FIG. 6 is a graph showing sensor output values of the different reflection members with respect to light intensities of a light emitting portion.

FIGS. 5A, 5B, and 5C are diagrams illustrating reflectances of different reflection members. FIG. 6 is a graph showing the sensor output values of the different reflection members with respect to light intensities of the light emitting portion 301.

First, a difference of the regular reflection light SR with respect to a difference of the reflection member irradiated with light from the light emitting portion 301 will be described.

In FIGS. 5A, 5B, and 5C, lengths of arrows designating the regular reflection light SR are different from each other. The difference between lengths of the arrows indicates a difference between light intensity of the regular reflection light SR. In other words, a relationship of "(SR length in FIG. 5A)>(SR length in FIG. 5C)>(SR length in FIG. 5B)" indicates a relationship of "(light intensity of regular reflection light SR in FIG. 5A)>(light intensity of regular reflection light SR in FIG. 5C)>(light intensity of regular reflection light SR in FIG. 5B)". FIG. 5A is a diagram illustrating reflection of the intermediate transfer belt 31. Because a reflectance RA of the intermediate transfer belt 31 is high, light intensity of the regular reflection light SR in the reflection light as illustrated in FIG. 5A is larger than that of the regular reflection light SR in FIG. 5B or in FIG. 5C. As indicated by a line RAX in FIG. 6, when the light intensity of the light emitting portion 301 is increased, the sensor output value of the regular reflection light receiving portion 302 is linearly increased, and is limited at light intensity Qb to a waveform range maximum value after electric signal conversion.

FIG. 5B is a diagram illustrating reflection of the toner pattern 201 for position detection purpose which is formed on the intermediate transfer belt 31. A reflectance RB of the toner pattern 201 for position detection purpose which is formed on the intermediate transfer belt 31 is low. In addition, the toner surface of the toner pattern 201 for position detection purpose is not a smooth flat surface unlike the intermediate transfer belt 31. Thus, a ratio of the diffuse reflection light DR is large. Therefore, as illustrated in FIG. 5B, a ratio of the regular reflection light SR is decreased so that the sensor output value of the regular reflection light receiving portion 302 is low. As indicated by a line RBX in FIG. 6, when the light intensity of the light emitting portion 301 is increased, the sensor output value of the regular reflection light receiving portion 302 is linearly increased, but a rate of increase is lower than that of the line RAX. Note that, in FIG. 6, toner density of the toner pattern 201 for position detection purpose which is formed on the intermediate transfer belt 31 is a lowest density which can be assumed.

FIG. 5C is a diagram illustrating reflection of the flaw F1 or the dirt F2 on the intermediate transfer belt 31. A reflectance RC of the flaw F1 or the dirt F2 caused by an external factor such as the manufacturing process or deterioration over time is lower than the reflectance RA of the intermediate transfer belt 31 but is higher than the reflectance RB of the toner pattern 201 for position detection purpose. Therefore, as illustrated in FIG. 5C, a ratio of the regular reflection light SR is smaller than that of the intermediate transfer belt 31 and is larger than that of the toner pattern 201 for position detection purpose. As indicated by a line RCX in FIG. 6, when the light intensity of the light emitting portion 301 is increased, the sensor output value of the regular reflection light receiving portion 302 is linearly increased, and is limited at light intensity Qc to the waveform range maximum value after the electric signal conversion. In other words, if irradiation light intensity increases to Qc, a CPU 901 cannot distinguish whether the sensor output from the regular reflection light receiving portion 302 is an output obtained by the reflection light from the intermediate transfer belt 31 or an output obtained by the reflection light from the flaw F1 or the dirt F2. Note that, in FIG. 6, the reflectance RC of the flaw F1 or the dirt F2 caused by an external factor such as the manufacturing process or deterioration over time is a lowest reflectance which can be assumed.

As described above, a dynamic range R2 at the light intensity Qc of the light emitting portion 301 in which the flaw F1 or the dirt F2 is not detected is larger than a dynamic range R1 at the light intensity Qa in which the flaw F1 or the dirt F2 is not detected. When the light intensity of the light emitting portion 301 is the same, the sensor output value of the toner pattern 201 for position detection purpose is different from the sensor output value of the flaw F1 or the dirt F2. In other words, when the light intensity of the light emitting portion 301 is the same, the sensor output value of the flaw F1 or the dirt F2 is larger than the sensor output value of the toner pattern 201 for position detection purpose. When the light intensity of the light emitting portion 301 is increased, the difference of the sensor output value between the toner pattern 201 for position detection purpose and the flaw F1 or the dirt F2 is increased. Therefore, by increasing the light intensity of the light emitting portion 301, the dynamic range in which the flaw F1 or the dirt F2 is not detected is increased.

Figure 7A:
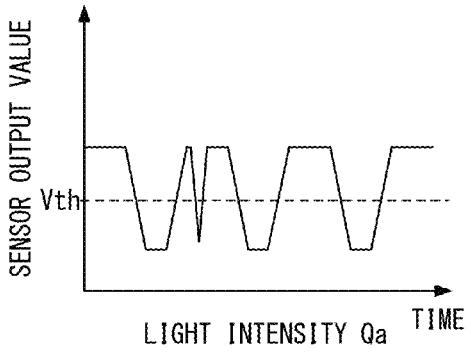
FIGS. 7A and 7B are graphs showing a difference of the sensor output value for a flaw or dirt when the light intensity of the light emitting portion is changed.
Figure 7B:
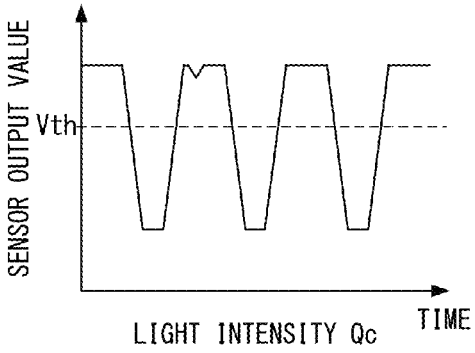

Next, the sensor output values at the light intensity Qa and at the light intensity Qc in FIG. 6 will be described with reference to FIGS. 7A and 7B. FIGS. 7A and 7B are graphs showing a change in the sensor output values of the flaw F1 or the dirt F2 when the light intensity of the light emitting portion 301 is changed. FIG. 7A is a graph showing the sensor output value of the regular reflection light receiving portion 302 at the light intensity Qa of the light emitting portion 301. FIG. 7B is a graph showing the sensor output value of the regular reflection light receiving portion 302 at the light intensity Qc of the light emitting portion 301.

At the light intensity Qa of the light emitting portion 301, if the flaw F1 or the dirt F2 exists, the sensor output value of the flaw F1 or the dirt F2 is smaller than the threshold voltage Vth. Therefore, as illustrated in FIG. 4B, the flaw F1 or the dirt F2 may be detected erroneously as the toner pattern 201 for position detection purpose. Therefore, the accuracy in correction of color misregistration may be deteriorated.

In contrast, at the light intensity Qc of the light emitting portion 301, even if the flaw F1 or the dirt F2 exists, the sensor output value of the flaw F1 or the dirt F2 is larger than the threshold voltage Vth. Therefore, the flaw F1 or the dirt F2 is not detected erroneously as the toner pattern 201 for position detection purpose. In other words, the light intensity of the light emitting portion 301 is increased so that the sensor output value of the flaw F1 or the dirt F2 from the regular reflection light receiving portion 302 is limited to the waveform range maximum value after the electric signal conversion. In this way, it is possible to stably detect only the toner pattern 201 for position detection purpose irrespective of the flaw F1 or the dirt F2. Thus, deterioration of the accuracy in correction of color misregistration can be prevented. In order to securely detect the toner pattern 201 for position detection purpose, it is preferred to set the threshold voltage Vth to be approximately a median between the sensor output value of the intermediate transfer belt 31 and the sensor output value of the toner pattern 201 for position detection purpose.

When the light intensity of the light emitting portion 301 is increased so that the sensor output value of the flaw F1 or the dirt F2 becomes the threshold voltage Vth or higher, the toner pattern 201 for position detection purpose can be detected without detecting the flaw F1 or the dirt F2.

Figure 8:
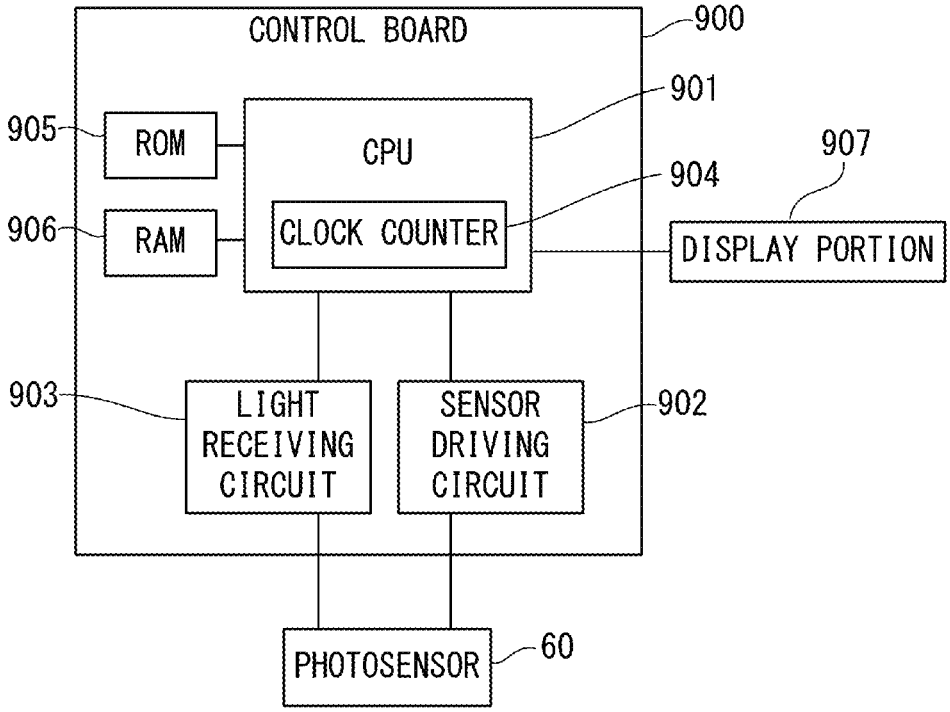
FIG. 8 is a block diagram illustrating a structure configured to adjust the light intensity of the light emitting portion.

FIG. 8 is a block diagram illustrating a structure configured to adjust the light intensity of the light emitting portion 301. With reference to FIG. 8, the structure configured to adjust the light intensity of the light emitting portion 301 will be described.

A control board 900 is mounted to the control unit 80 of the image forming apparatus 1. The CPU (control device) 901, the sensor driving circuit (control device) 902, the light receiving circuit 903, and a display portion 907 are mounted on the control board 900. The CPU 901 is electrically connected to the sensor driving circuit 902 and the light receiving circuit 903. The sensor driving circuit 902 and the light receiving circuit 903 are electrically connected to the photosensor 60. The display portion 907 displays instructions from the CPU 901.

The CPU 901 drives the sensor driving circuit 902. As illustrated in FIGS. 3A and 3B, the sensor driving circuit 902 drives the light emitting portion 301 of the photosensor 60. The light emitted from the light emitting portion 301 and reflected by the intermediate transfer belt 31, the toner pattern 201 for position detection purpose, the flaw F1, or the dirt F2 is received by the regular reflection light receiving portion 302 and the diffuse reflection light receiving portion 303 of the photosensor 60. The light receiving circuit 903 performs A/D conversion of the electric signal 502 (FIG. 4A) having an analog waveform as the sensor output value from the regular reflection light receiving portion 302 and the diffuse reflection light receiving portion 303 into the rectangular wave 503 (FIG. 4A) by using the threshold voltage Vth. The CPU 901 receives the rectangular wave 503 after the A/D conversion. The clock counter 904 inside the CPU 901 counts between the edges of the rectangular wave 503 so as to measure the gap G.

Figure 9:
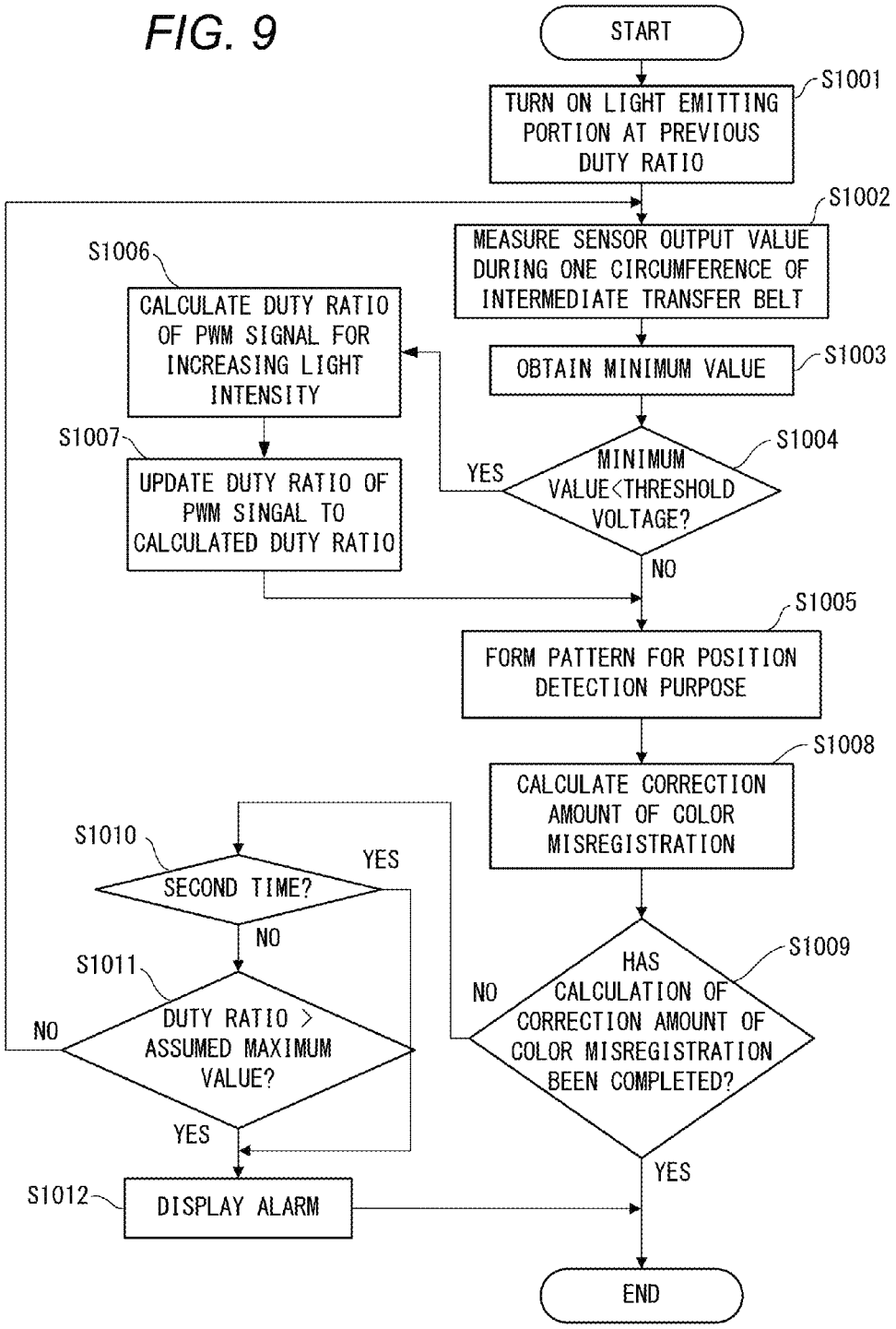
FIG. 9 is a flowchart illustrating a calculation sequence of a correction amount of color misregistration.

Next, with reference to a flowchart of FIG. 9, a description will be provided of light intensity adjustment of the light emitting portion 301 in calculation of the correction amount of color misregistration. FIG. 9 is a flowchart illustrating a calculation sequence of the correction amount of color misregistration. A program for calculating the correction amount of color misregistration is stored in a ROM (storage medium) 905. The CPU 901 reads the program from the ROM 905. The calculation of the correction amount of color misregistration is performed every time when a predetermined period elapses, and/or every time when image formation on a predetermined number of sheets is performed, and/or when the image forming apparatus 1 is powered on, and/or in a sleep resume operation in which the image forming apparatus 1 is resumed from a sleep state to a normal standby state.

When the image forming apparatus 1 starts the calculation of the correction amount of color misregistration, the CPU 901 controls the photosensor 60 to detect the sensor output value (analog signal value) of the intermediate transfer belt 31 before the toner pattern 201 for position detection purpose is formed. Specifically, the CPU 901 first turns on the light emitting portion 301 at the previous duty ratio (current set value) of the PWM signal (S1001). The previous duty ratio of the PWM signal is stored in a RAM 906. If the intermediate transfer belt is exchanged with another one, the light emitting portion 301 is turned on at an initially set (default) duty ratio. Next, the CPU 901 controls the intermediate transfer belt 31 to rotate one revolution while the regular reflection light SR from the intermediate transfer belt 31 is received by the regular reflection light receiving portion 302 so that the sensor output value (analog signal value) as the electric signal having an analog waveform is measured (S1002). The CPU 901 determines a minimum value from the obtained sensor output values (detection values, output profile) for one circumference (S1003). Note that, the intermediate transfer belt 31 may be controlled to be rotated by a plurality of revolutions so as to measure the sensor output values for the plurality of times of circulation of the circumference of the intermediate transfer belt 31, and average values of the measured values may be determined and used as the sensor output values (output profile) for one circumference of the intermediate transfer belt 31. It is because a more appropriate light intensity of the light emitting portion 301 can be determined by controlling the light intensity of light irradiating the intermediate transfer belt 31 and the toner pattern for position detection purpose so that the minimum value of the output profile becomes the threshold voltage Vth or higher.

The CPU 901 determines whether or not the minimum value is smaller than the threshold voltage Vth (S1004). In other words, the CPU 901 determines whether or not the sensor output values (analog signal values) for one circumference of the intermediate transfer belt 31 includes a value lower than the threshold voltage Vth. The threshold voltage Vth is determined in advance from the sensor output values (analog signal values) of the intermediate transfer belt 31 and the sensor output values (analog signal values) of the toner patterns 201 for position detection purpose and is stored in the RAM 906.

If the minimum value is smaller than the threshold voltage Vth (YES in S1004), the CPU 901 increases the light intensity of the light emitting portion 301 by the sensor driving circuit 902. The light intensity of the light emitting portion 301 is increased so that the minimum value of the sensor output values becomes the threshold voltage Vth or higher. Specifically, the CPU 901 and the sensor driving circuit 902 control the light intensity of the light from the photosensor 60 irradiating the intermediate transfer belt 31 and the toner patterns 201 for position detection purpose which are transferred onto the intermediate transfer belt 31. Thus, the analog signal values based on the light intensity of the regular reflection light from the intermediate transfer belt 31 become higher than the threshold voltage Vth. In this way, the flaw F1 or the dirt F2 on the intermediate transfer belt 31 can be prevented from being erroneously recognized as the toner pattern 201 for position detection purpose. In order to increase the light intensity of the light emitting portion 301, the CPU 901 calculates the duty ratio of the PWM signal by using a predetermined interpolation table or a linear operation utilizing linearity of the sensor output value with respect to the light intensity (S1006). Further, the CPU 901 updates the duty ratio of the PWM signal to the calculated duty ratio (current set value) (S1007). The CPU 901 forms the toner pattern 201 for position detection purpose on the intermediate transfer belt 31 (S1005). The CPU 901 drives the light emitting portion 301 at the updated duty ratio and determines the sensor output value at the increased light intensity so as to calculate the correction amount of color misregistration (S1008).

If the minimum value is the threshold voltage Vth or higher (NO in S1004), the CPU 901 forms the toner pattern 201 for position detection purpose on the intermediate transfer belt 31 (S1005). The CPU 901 drives the light emitting portion 301 at the previous duty ratio so as to determine the sensor output value at the previous light intensity and calculate the correction amount of color misregistration (S1008).

The CPU 901 determines whether or not the calculation of the correction amount of color misregistration has been completed (S1009). If the calculation of the correction amount of color misregistration is completed (YES in S1009), the calculation of the correction amount of color misregistration is ended. When the image is formed, the control unit 80 performs the correction of color misregistration in accordance with the calculated correction amount of color misregistration.

If the toner pattern 201 for position detection purpose cannot be recognized or if the number of the detected toner patterns 201 for position detection purpose is small so that the calculation of the correction amount of color misregistration is not completed (NO in S1009), the process proceeds to S1010. In S1010, the CPU 901 determines whether or not it is the second time that the calculation of the correction amount of color misregistration is not completed. If it is the second time (YES in S1010), the process proceeds to S1012. If it is not the second time (NO in S1010), the process proceeds to S1011.

In S1011, the CPU 901 determines whether or not the duty ratio is larger than the maximum value which can be assumed (hereinafter referred to as an assumed maximum value).

If the duty ratio is smaller than the assumed maximum value (limit value) (NO in S1011), the process returns to S1002 in which the calculation of the duty ratio is performed again. Here, the assumed maximum value means a duty ratio that causes the light emitting portion 301 to generate such light intensity that the sensor output value of the toner pattern 201 for position detection purpose exceeds the threshold voltage Vth. If the sensor output value of the toner pattern 201 for position detection purpose exceeds the threshold voltage Vth, the toner pattern 201 for position detection purpose cannot be recognized, and hence the correction amount of color misregistration cannot be calculated.

If the duty ratio is larger than the assumed maximum value (YES in S1011), the CPU 901 displays a warning on the display portion 907 of the image forming apparatus 1 (S1012). The CPU 901 ends the process without performing the calculation of the correction amount of color misregistration. When the image is formed, the control unit 80 performs the color misregistration correction in accordance with the previous correction amount of color misregistration.

According to the embodiment, even if the image bearing member includes a part having locally low reflectance, it is possible to suppress deterioration of the accuracy in correction of color misregistration.

Other Embodiments

In addition, the present invention can also be realized by performing the following process. Software (a program) for realizing the functions of the embodiment described above is supplied to the system or the apparatus via a network or various storage media, and a computer (or a CPU, an MPU, or the like) of the system or the apparatus reads and executes the program.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-203902, filed on Sep. 18, 2012, which is hereby incorporated by reference herein in its entirety.

What is claimed is:

1. An image forming apparatus, comprising:

an image forming unit configured to form toner images, to be transferred onto a recording medium, on an image bearing member on which the toner images formed on a plurality of photosensitive members by the image forming unit are transferred by the image forming unit, wherein the image forming unit forms toner patterns for detecting a relative position of the toner images on the image bearing member;

a detection unit including:

a light emission unit configured to irradiate with light the image bearing member and the toner patterns; and a light receiving unit disposed at a position for receiving reflection light of the light emitted from the light emission unit and reflected from the image bearing member and the toner patterns, the detection unit being configured to output an analog signal based on a light intensity of the reflection light;

a conversion unit configured to convert the analog signal into a binary signal based on a predetermined threshold value;

a correction unit configured to correct a misregistration between the toner images transferred onto the recording medium based on the binary signal; and a control unit configured to control, when values of the analog signal based on the light intensity of the reflection light from the image bearing member include a value lower than the threshold value, light intensity of the light from the light emission unit irradiating the image bearing member and the toner patterns so that the values of the analog signal based on the light intensity of the reflection light from the image bearing member become higher than the threshold value.

2. An image forming apparatus according to claim 1, wherein the light receiving unit is disposed on an optical path of regular reflection light of the light from the light emission unit irradiating the image bearing member and the toner patterns and regularly reflected by the image bearing member and the toner patterns.

3. An image forming apparatus according to claim 1, wherein the control unit controls the detection unit to detect the image bearing member before the toner patterns are formed, to determine the analog signal of the image bearing member.

4. An image forming apparatus according to claim 1, wherein the control unit determines in advance the threshold value from the values of the analog signal of the image bearing member and the values of the analog signal of the toner patterns.

5. An image forming apparatus according to claim 1, wherein the control unit determines the light intensity by using a linear operation utilizing linearity of the values of the analog signal with respect to the light intensity or a predetermined interpolation table.

6. An image forming apparatus according to claim 1, wherein the control unit controls the detection unit to detect the image bearing member, which is rotated, to obtain a profile of the values of the analog signal for one circumference of the image bearing member.

7. An image forming apparatus according to claim 1, wherein the control unit controls the detection unit to detect the toner patterns every time when a predetermined period elapses, every time an image formation for a predetermined number of sheets is performed, at a time when the image forming apparatus is powered on, and/or in a sleep resume operation in which the image forming apparatus is resumed from a sleep state to a normal standby state.

8. An image forming apparatus according to claim 1, further comprising a display unit configured to display information based on an instruction from the control unit, wherein the control unit controls the display unit to display a warning when the light intensity is larger than a limit value at which the detection unit becomes unable to detect the toner patterns.

9. An image forming apparatus according to claim 1, wherein the image bearing member comprises an intermediate transfer belt to which the toner images of the plurality of photosensitive members are transferred and from which the toner images are transferred onto the recording medium.

10. An image forming apparatus according to claim 9, wherein the control unit controls the detection unit to detect the intermediate transfer belt, which is rotated, calculates average values of the analog signals for a plurality of times of circulation of a circumference of the intermediate transfer belt as a profile of one circumference of the intermediate transfer belt, and controls the light intensity of the light from the detection unit irradiating the intermediate transfer belt and the toner patterns which are transferred onto the intermediate transfer belt so that the profile becomes higher than the threshold value.

11. A method of setting a light intensity of light to be emitted from a light emission unit of an image forming apparatus, the image forming apparatus including an image forming unit configured to form toner images, to be transferred onto a recording medium, on an image bearing member on which the toner images formed on a plurality of photosensitive members by the image forming unit are transferred by the image forming unit, wherein the image forming unit forms toner patterns for detecting a relative position of the toner images on the image bearing member, a detection unit including the light emission unit configured to irradiate with light the image bearing member and the toner patterns and a light receiving unit disposed at a position for receiving reflection light of the light emitted from the light emission unit and reflected from the image bearing member and the toner patterns and outputting an analog signal based on a light intensity of the reflection light, a conversion unit configured to convert the analog signal into a binary signal based on a predetermined threshold value, and a correction unit configured to correct a misregistration between the toner images transferred onto the recording medium based on the binary signal, the method comprising:

a light receiving step of causing the light receiving unit to receive the reflection light from the image bearing member by emitting light from the light emission unit to the image bearing member;

a determination step of determining whether the analog signal generated by the light receiving unit based on the reflection light from the image bearing member received by the light receiving unit in the light receiving step is not larger than the predetermined threshold value; and a setting step of setting the light intensity for irradiating the image bearing member and the toner patterns for detecting the toner patterns to a first light intensity in a case where the analog signal generated by the light receiving unit is larger than the predetermined threshold value in the determination step, and setting the light intensity for irradiating the image bearing member and the toner patterns for detecting the toner patterns to a second light intensity higher than the first light intensity in a case where the analog signal generated by the light receiving unit is not larger than the predetermined threshold value in the determination step, wherein the first light intensity and the second light intensity are set so that the analog signal based on the light intensity of the reflection light from the image bearing member becomes higher than the predetermined threshold value.

* * * * *